US005507664A

United States Patent [19]

Carmo

[11] Patent Number: 5,507,664

[45] Date of Patent: Apr. 16, 1996

[54] RELEASABLE POWER SUPPLY CORD CONNECTOR FOR PANEL MOUNTED POWER CONNECTORS

[75] Inventor: Robert A. Carmo, Placentia, Calif.

[73] Assignee: Pacific Electricord Company, Gardena, Calif.

[21] Appl. No.: 263,632

[22] Filed: Jun. 22, 1994

[51] Int. Cl.[6] ..... H01R 13/62

[52] U.S. Cl. ..... 439/372; 439/369

[58] Field of Search ..... 439/345, 347, 439/350, 358, 366, 368, 369, 372, 373, 544

[56] References Cited

U.S. PATENT DOCUMENTS

| | | | |
|---|---|---|---|
| 1,665,095 | 4/1928 | Henry | 439/369 X |
| 1,925,716 | 9/1933 | D'olier, Jr. | 439/369 |
| 1,989,823 | 2/1935 | Raabe | 439/369 X |
| 4,449,776 | 5/1984 | Carmo et al. . | |
| 4,652,069 | 3/1987 | Smith | 439/369 |
| 4,752,236 | 6/1988 | Carmichael et al. | 439/372 |

*Primary Examiner*—Khiem Nguyen
*Attorney, Agent, or Firm*—Paul J. Sutton

[57] ABSTRACT

An adapter for holding in assembly the connectors of two electrical cables. The base of the adapter is fastened over at least a part of the first connector and attached below or on a mounting panel. The second connector is matingly coupled to the first in the adapter and a locking member, pivotally mounted on the base, is placed over the second connector to prevent separation of the connectors and provide strain relief to the second cable/connector joints.

13 Claims, 4 Drawing Sheets

RELEASABLE POWER SUPPLY CORD CONNECTOR FOR PANEL MOUNTED POWER CONNECTORS

BACKGROUND OF THE INVENTION

1. Field of the Invention

The invention relates to mateable electrical connectors and more particularly an adapter which can be used to insure the joint between a multiple conductor panel mounted connector and a mateable connector upon a cable such as a power cable and provide strain relief for such cable.

2. Description of the Prior Art

One known prior art device is shown in U.S. Pat. No. 4,449,776 issued May 22, 1984. In that device the electrical conductors are terminated in special connectors which permit locking and strain relief to be carried out but connectors without these special body parts on them cannot be joined. It is not possible to merely provide an adaptive structure which can be used with existing connectors as is true of the instant device.

A second device available in the prior art makes use of a restraint made up of a specially bent length of high gauge metal rod mounted in special mounting fasteners with apertures in their heads so that the ends of the rod can enter the apertures allowing the restrain to pivot through an arc of 90° from a non-engaging position to an engaging position. In the first position, the connector can be joined to the panel connector or withdrawn. With the restraint in the second position, withdrawal of the connector is not possible. Withdrawal of the connector is prevented by the engagement of two spaced apart arms with slots in a special connector. Without the special connector with the appropriate slots the restraint is inoperative to prevent connector separation.

SUMMARY OF THE INVENTION

The instant invention overcomes the difficulties noted above with respect to prior art devices by providing an adapter arrangement which can be mounted upon an existing panel mounted connector and which provides a locking arrangement to retain a connector of a cable in engagement with the panel connector and which provides strain relief for the cable connected to the panel mounted connector.

The adapter base member has a base with two parallel spaced apart arms extending away from the front surface of the base member and flanking an aperture into which a panel mounted connector extends. The base member is behind or on a panel or mounting wall and is held to such panel or mounting wall and the panel mounted connector by two fasteners. A recess on the back surface fixes the position of the panel mounted connector with respect to the adapter.

A locking member is made up of a transverse member which has two parallel spaced apart locking arms extending from its ends. By a pin and aperture arrangement on the arms of the base member and locking arms of the locking member, the base member and locking member are free for relative rotational movement. A set of guides receives the reduced thickness ends of the base member arms to make for easy relative rotation and prevent lateral motion of the parts when in their assembled position on the cable connector. The transverse member has a recess which produces two shoulders to prevent the withdrawal of the connector and the cable entrance has an annulus thereabout to engage the cable insulation or jacket and act as a strain relief to prevent forces applied to the cable to be transferred to the connector-cable joints.

In the first position the locking member is placed at 90° to the cable installation direction, preventing it from impeding connector assembly. Once the cable connector and panel connector are properly joined the locking member is rotated 90° to place it in a horizontal plane over the connector and cable. A set of shoulders fit behind the connector and prevent its withdrawal and the strain relief annulus adjacent the entrance to the locking member engage the cable insulation to prevent any forces applied to the cable causing the connectors to separate or causing the conductors to pull out of the connector contacts. It is an object of this invention to provide an improved connector assembly device and system.

It is another object of this invention to provide an adapter for use with a panel mounted connector to prevent unwanted separation of the connectors and strain relief for the cable.

It is yet another object of this invention to provide an adapter for use with existing connectors to prevent unwanted separation and strain relief.

Other objects and features of the invention will be pointed out in the following description and claims and illustrated in the accompanying drawings, which disclose, by way of example, the principles of the invention, and the best modes which have been presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
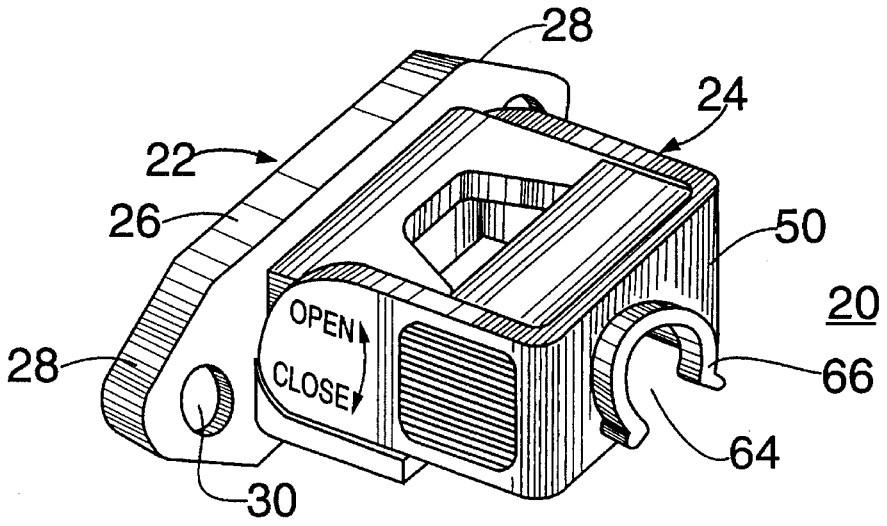
FIG. 1 is a top front perspective view of a first embodiment of connector adapter constructed in accordance with the concepts of the invention.
Figure 2:
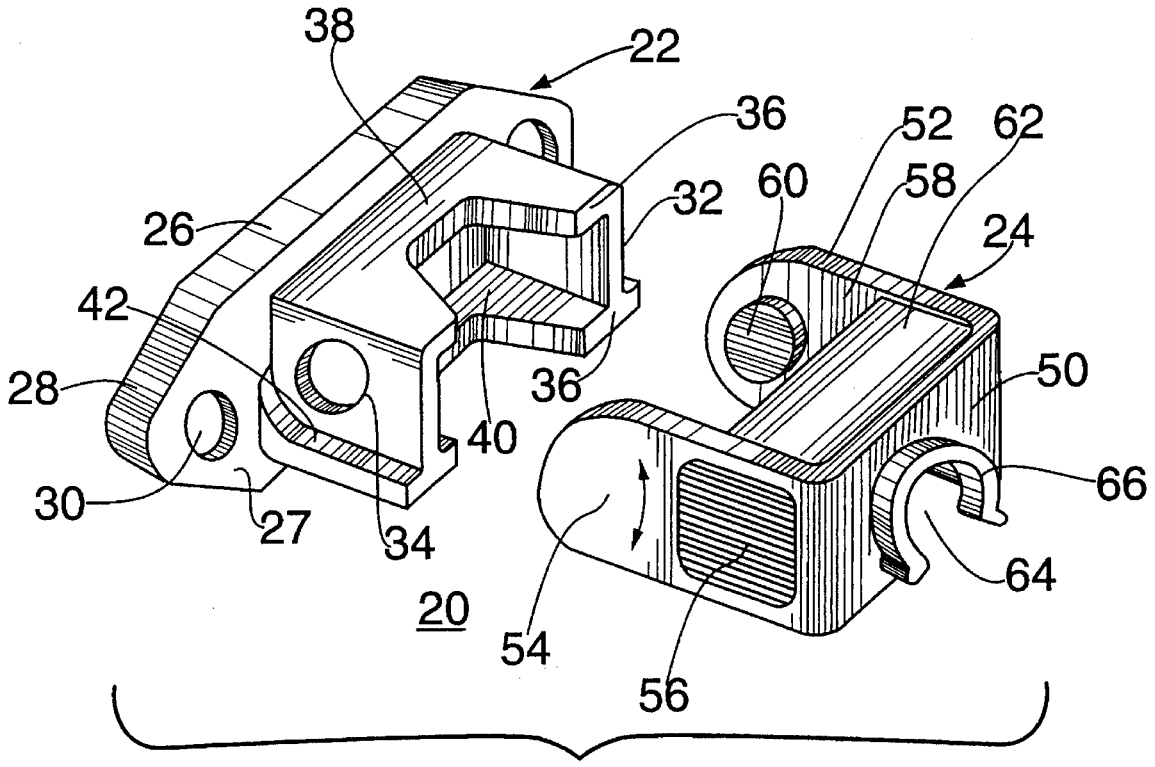
FIG. 2 is similar to FIG. 1 with the components separated to better show the details of such components.
Figure 3:
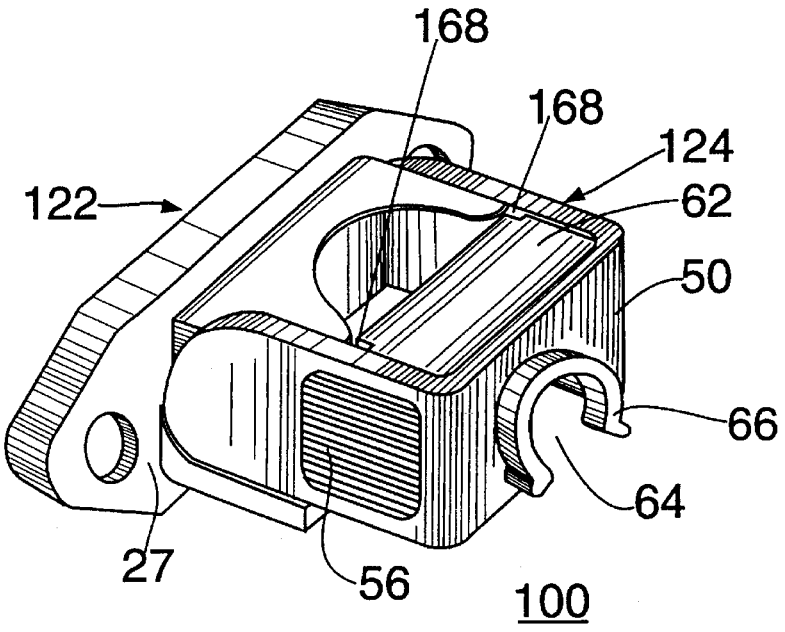
FIG. 3 is a top front perspective view of a second embodiment of a connector adapter constructed in accordance with the concepts of the invention.
Figure 4:
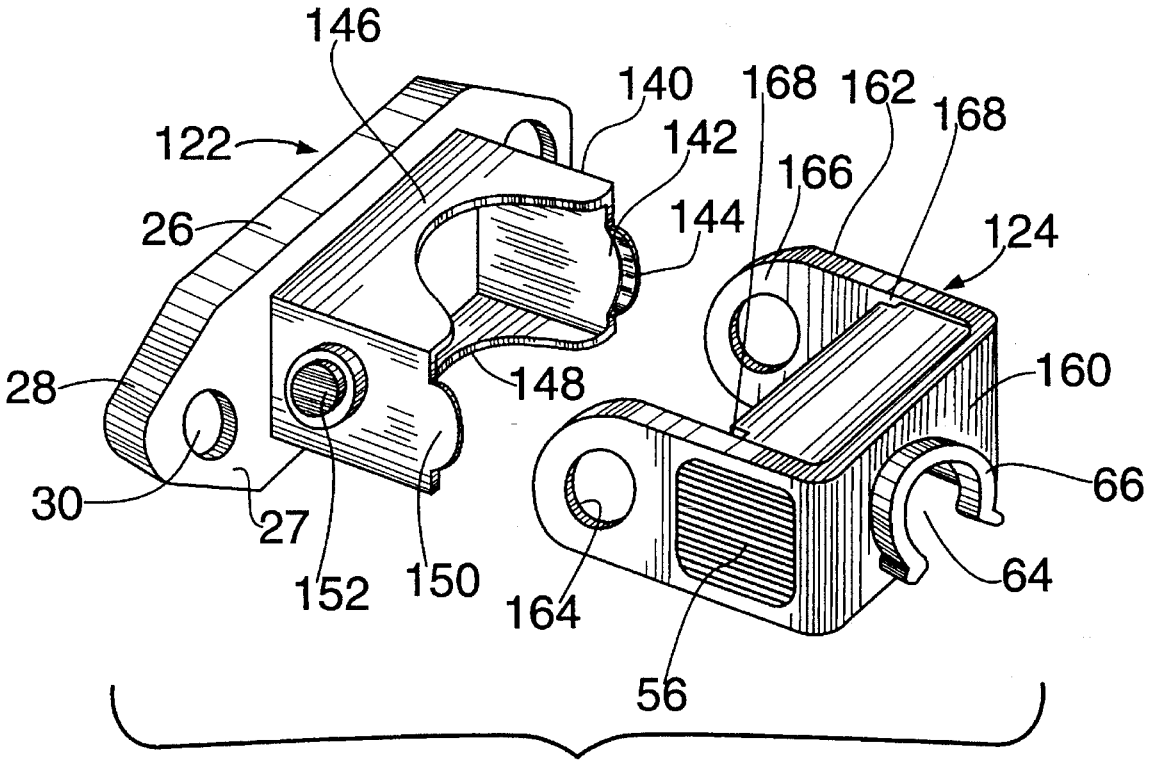
FIG. 4 is similar to FIG. 3 with the components separated to better show the details of such components.
Figure 5:
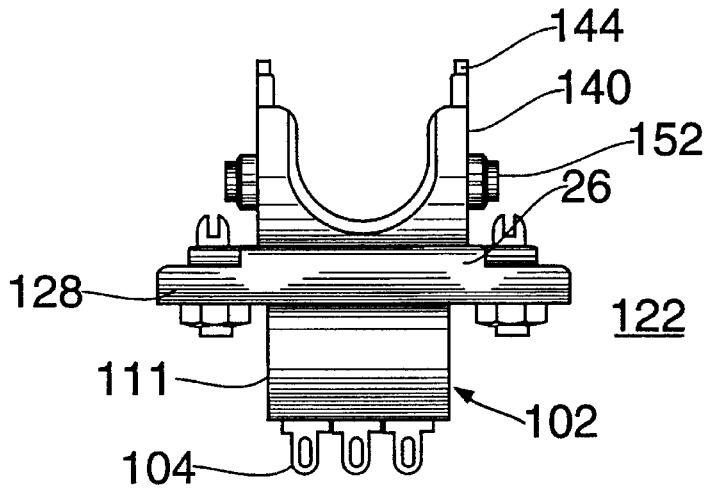
FIG. 5 is a top plan view of a body member of the instant invention joined to typical panel mounted connector.

Turning now to FIGS. 1 and 2 there is shown one embodiment of an adapter 20 constructed in accordance with the concepts of the invention. Adapter 20 has two major component parts, the base member 22 and the locking member 24 joined, as will be described below, to permit relative rotation of one member with respect to the other. Base member 22 has a base portion 26 which is tapered at both ends, as at 28, and contains a mounting aperture 30 which extends through the base portion 26 to receive fasteners such as bolts and nuts (not shown) to anchor the base member 22 on a mounting panel front or rear surface. Two generally parallel spaced apart arms 32 extend from the front surface 27 of base portion 26 to accept therebetween a portion of a panel mounted connector (not shown) which is joined to base member 22 by fasteners (not shown) which unites base member 22 and the panel mounted connector and secures them to a mounting surface (not shown). Each of the arms 32 has an aperture 34 therein and inwardly positioned flanges 36 which help to contain and restrain a female connector inserted therein. In addition, a partial upper wall 38 and a partial lower wall 40 also join the arms 32. An exterior partially curved lip 42 extends along the bottom outside edge of arms 32 which acts as a guide for the arms of the locking member 24 when moving in one direction and prevents movement of the locking member 24 in the opposite direction.

Locking member 24 has a transverse member 50 from which project two spaced apart arms 52 having an exterior surface 54 on which is placed a ridged area 56 which permits the locking member 24 to be securely grasped. From the interior surface 58 of arms 52 project short pins 60 which engage the apertures 34 of base member arms 32. The spacing between the interior surface 58 of arms 52 is slightly greater than the spacing between the exterior surfaces of base member arms 32 so that locking member arms 52 can move over base member arms 32 without difficulty once the pins 60 are positioned in apertures 34. Transverse member 50 has a top wall 62 and an aperture 64 about which is placed a strain relief rib 66.

As will be described below, the adapter 20 is assembled to a male connector and a panel (not shown) so that a part of the connector is positioned between the arms 32. The locking member 24 is rotated upwardly so as to leave the entrance to the male connector open. The lip 42 acts as a rear guide for movement of the locking member 24 from the horizontal position to the up ninety degree position and back but acts as a stop to prevent the movement of locking member 24 from the horizontal position to the down 90° position. With locking member 24 in the up 90° position, a female connector can now be moved into the base member 22 to engage the male connector therein.

The locking member 24 is now returned to its horizontal position where the strain relief rib 66 grasps the cable insulation of the cable attached to the female connector (not shown). Also shoulders in the locking member 24 (to be described below) act on the rear portion of the inserted female connector to prevent its withdrawal.

Figure 8:
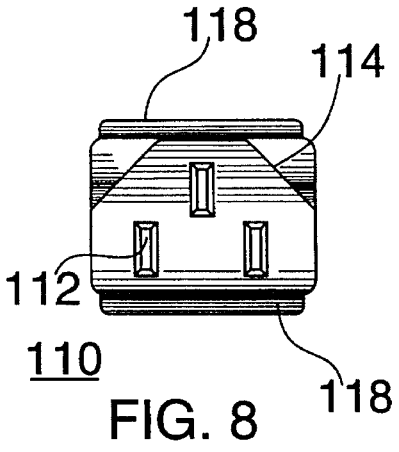
FIG. 8 is a front elevational view of the female power cord connector of FIG. 7.
Figure 9:
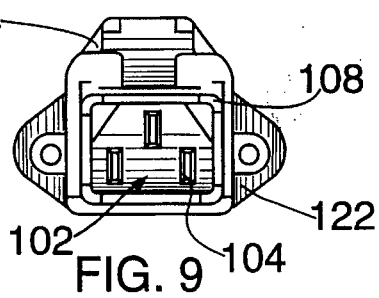
FIG. 9 is front elevational view of the male panel connector of FIG. 8 showing such male connector installed to the base member of the instant invention with the locking member in the open position so that the interior of the base member is visible.

Turning now to FIGS. 3 to 12 there is shown a further embodiment of an adapter constructed in accordance with the concepts of the invention. The adapter 100 is intended to hold assembled a male connector 102 of the type commonly found on typewriters, computers and the like to provide power for the operation of these devices. Connector 102, as seen in FIG. 9, has a generally rectangular socket with inclined walls adjacent each of the upstanding walls and top wall to permit assembly of connector 102 with a plug in only one orientation thus avoiding crossed wires and possible short circuits. Connector 102 has three male contacts 104 which extend into the socket.

Figure 7:
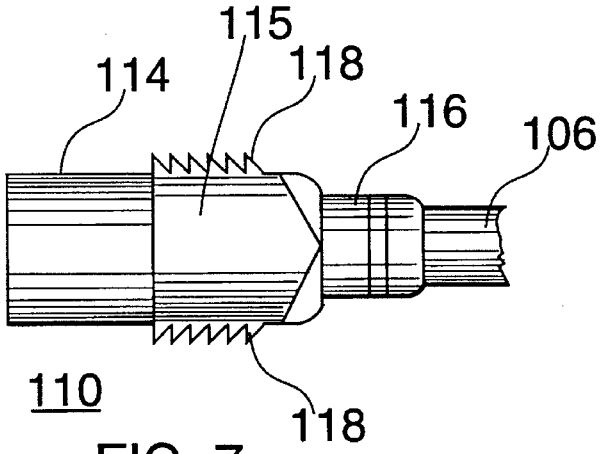
FIG. 7 is a side elevational view of a typical power cord with attached female connector.

The mating female connector 110 is best seen in FIGS. 7 and 8. Power cord 106 has three conductors and may have shield layers as well. As is widely done in the field, each of the conductors is terminated in a female contacts 112 and covered by insulating material molded about it to form a plug 114 and a body 115. A strain relief 116 may also be molded about the power cord 106 at the same time. The outer configuration of plug 114 is also generally rectangular with the corners between the upstanding sides and top removed so as to mate with the socket of connector 102. A series of ridges 118 are formed on the top and bottom walls of body 115 beyond the engagement area to facilitate insertion and removal of plug 114 with connector 102.

Figure 10:
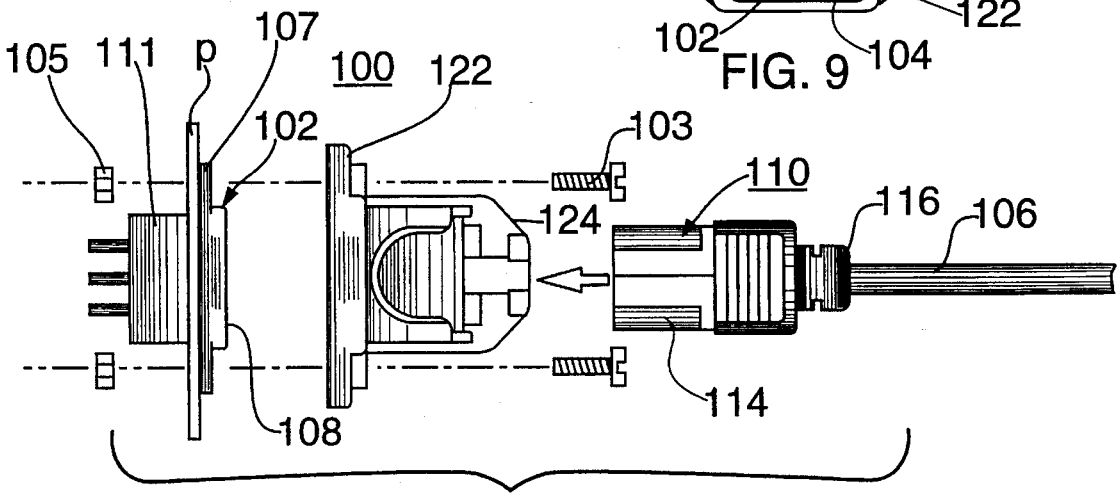
FIG. 10 is an exploded, bottom plan view of an adapter with a power cord terminated in a female connector, a panel mountable connector and the fasteners required to complete the assembly.
Figure 11:
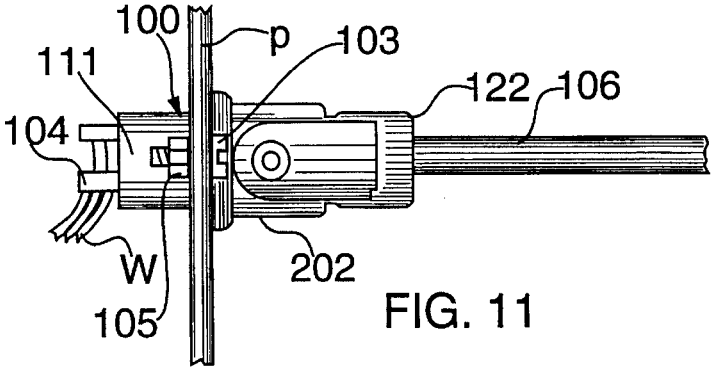
FIG. 11 is a side elevational view of the components of FIG. 10 assembled to a mounting panel.
Figure 12:
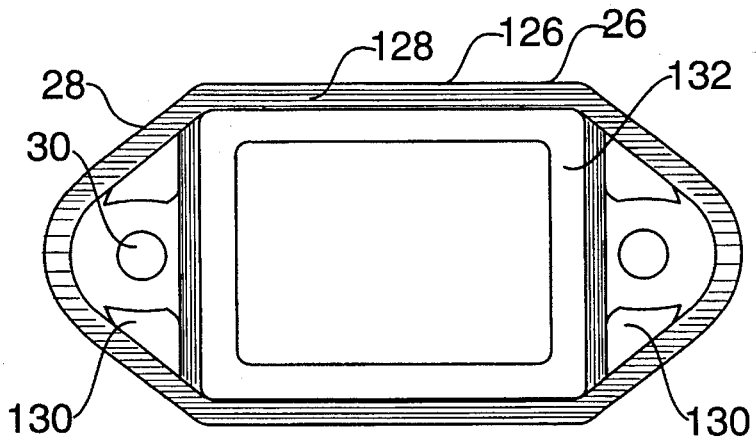
FIG. 12 is a rear elevational view of the base member of FIG. 5.

Base member 122 has a base portion 26, tapered at its ends as at 28 with mounting holes 30 therethrough. A peripheral wall 128 (see FIG. 12) extends about the entire periphery of the rear surface 126 to define two recesses 130 into which the mounting ears 107 (see FIG. 10) of the connector 102 are placed, and a deeper recess 132 into which the lip 108 (see FIG. 10) about the body 111 of connector 102 can be placed so that the entire lip 108 and ears 107 of connector 102 are within the height of the peripheral wall 128, (see FIG. 5) and the connector 102 body 111 extends beyond body portion 26 and through a panel p as shown in FIG. 10. The contacts 102 extend beyond body 110 where they may be joined to conductors W within the typewriter, computer or the like as shown in FIG. 11.

Returning to FIGS. 3 and 4, from the front face 27 of base portion 26 extend two arms 140 spaced apart by the width of the plug 114 of the female connector 110. The ends 142 of the arms 140 are rounded and the region near the free ends 144 are of reduced thickness for reasons to be set forth below. A partial top wall 146 and a partial bottom wall 148 with arms 140 define part of the chamber into which the plug 114 of female connector 110 is positioned.

On the exterior surfaces 150 of each of the arms 140 is placed a pin 152 which together with apertures in the arms of the locking member 124 will permit relative movement of locking member 124 and base member 122.

Figure 6:
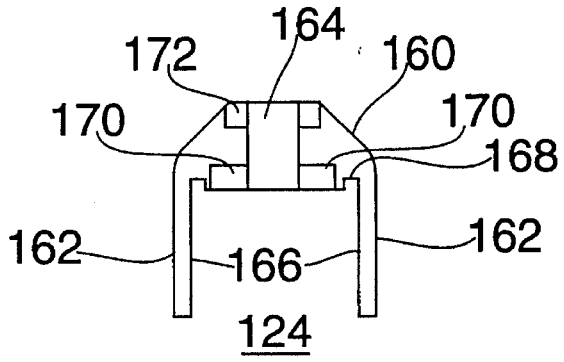
FIG. 6 is bottom plan view of locking member of the instant invention.

Locking member 124 is made up of a transverse member 160 from the ends of which project two parallel spaced apart arms 162, spaced by a distance greater than the distance between the exterior surfaces 150 of arms 140 so that arms 162 can move along arms 140 without contact. Arms 162 have apertures 164 adjacent the free ends thereof to receive therein the pins 152 so that body member 122 and locking member 124 can rotate with respect to each other. Turning to FIG. 6 additional details of the locking member 124 are visible. Adjacent each of the interior surfaces 166 of arms 162 in transverse member 160 are placed a curved recess 168 to receive the thinned and curved free ends 144 of the arms 140 and provide a guide for the relative movement of body member 122 and locking member 124 within a range of plus or minus 45° from the horizontal. This permits support of the locking member 124 as the transverse member 160 is brought into contact with the cable of the plug 114 of female connector 110. A large diameter cable can cause lateral movement of locking member 124 but this is prevented by the additional strengthening provided by the engagement of free ends 144 with recesses 168.

The walls that define the aperture 164 through the transverse member 160 are formed as a series of steps. Step 170 forms a stop for the properly seated female connector 110 by engaging the back wall of plug 114 to prevent the female connector 110 from being withdrawn from the male connector 102. Step 172 acts as a strain relief by engaging the cable 106 insulation or the molded strain relief 116. Any longitudinal forces applied to the cable are transferred to the connector body 110, the adapter 100 and mounting panel p to prevent separation of the cable conductors from the contacts 112 and to permit flexure of cable 106 without similar damage to the contact joints.

Where an adapter is to be retrofitted to an existing connector and the adapter is to be on the outside of the panel p but the existing connector is to remain on the inside of the panel a slightly different base member is used. A base member 202 as shown in FIG. 11 is employed. Base member 202 does not have a peripheral wall such as peripheral wall 128 of base member 122 shown in FIG. 12. As a result the rear surface 126 is flat and solid with no recesses such as 130 and 132. The mounting apertures 30 remain. The height of lip 108 above the body of connector 102 is the same as the panel p thickness so the lip 108 fits in the cut-out and the ears 106 and remainder of connector body 102 front surface are flat on the rear surface of panel p and the adapter body 202 is flat on the front surface of panel p. The fasteners 103 are now passed through apertures 30 in adapter body 202, the apertures in the panel p, the apertures in ears 105 of connector 102 to nuts 105 which hold all these components in assembly.

Thus the adapter system taught herein is useful equally for new installations or retrofit of existing installations because the present wiring does not have to be disturbed. The existing connector, the existing panel cutout and fastener holes can all be used. Once the adapter is in position locked to the panel p and the existing connector 102, the locking member is moved to its 90° off-set position and the connector 110 is united with connector 102. The locking member 24 or 124 is then moved into position so that the strain relief rib 64 firmly grips the cord boss 116 and the installation is complete.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A selectively applied lock member for maintaining the electrical connectors of first and second terminated electrical cables in full engagement and preventing their unwanted separation comprising:

a) a base member having two parallel, spaced apart arms and a base aperture therebetween to accept a portion of the electrical connector of said first electrical cable;

b) a lock member having a transverse member and two parallel, spaced apart locking arms, one extending from each of the two ends of said transverse member; the spacing between said locking arms being greater than the spacing between said base member arms and capable of accepting therebetween a portion of the electrical connector of said second electrical cable when the electrical connector of said second electrical cable is mated with the electrical connector of said first electrical cable in said base member;

c) said lock member having a restricted entrance in said transverse member, said restricted entrance contoured to grip the second electrical cable around substantially more than 180 degrees of its periphery when said electrical connectors of said first and second electrical cables are mated, said restricted entrance providing strain relief for said second electrical cable; and d) coupling means coupling said lock member locking arms to said base member arms permitting relative rotational motion between said lock member and said base member.

2. A selectively applied lock member as defined in claim 1, wherein said coupling means comprises:

a. two apertures, one in each of said two arms of said base member; and b. two pins, one on the inner surface of each of said locking arms of said lock member for mating engagement with their associated apertures in said arms of said base member whereby said base member and lock member may be rotated with respect to the other of said base member and lock member.

3. A selectively applied lock member as defined in claim 1, wherein said coupling means comprises:

a. two apertures, one in each of said locking arms of said lock member; and b. two pins, one on the outer surface of each of said two arms of said base member for mating engagement with their associated apertures in said locking arms of said lock member whereby each of said base member and lock member may be rotated with respect to the other of said base member and lock member.

4. A selectively applied lock member as defined in claim 1, wherein said arms of said base member each have a stop along a marginal edge on the outer surface thereof; each of said stops being engaged by its associated locking arm to limit the rotation of said lock member with respect to said base member and said base member with respect to said lock member.

5. A selectively applied lock member as defined claim 4, wherein the rotation of said lock member with respect to said base member and the rotation of said base member with respect to said lock member is limited to 90° of rotation.

6. A selectively applied lock member as defined in claim 1, further comprising grip areas on the outer surface of said lock arms adjacent their juncture with said transverse member to facilitate rotation of said lock member with respect to said base member.

7. A selectively applied lock member as defined in claim 1, wherein said base member further comprises two mounting ears, one adjacent each end of said base member; said two mounting ears, each having an aperture therethrough to mount said base member upon a mounting surface.

8. A selectively applied lock member as defined in claim 7, further comprising:

a. said base member having a front surface and a back surface;

b. a recess in said back surface of said base member to receive the electrical connector of said first electrical cable and position the apertures in the mounting ears of such electrical connector in line with said apertures in the mounting ears of said base member to permit the fasteners used to mount said base member to a mounting surface to also fix said electrical connector of said first electrical cable to said base member.

9. A selectively applied lock member as defined in claim 1, further comprising:

a. areas of reduced thickness at the free ends of said base arms; and b. a recess at the base of each locking arm adjacent its juncture with said transverse member each to receive the area of reduced thickness at the free end of its associated base arm for a portion of the rotational motion of said base member and said lock member.

10. A selectively applied lock member as defined in claim 9, wherein the free end of each of said base arms is arcuate and the recess at the base of each of said locking arms is complimentarily arcuate.

11. A selectively applied lock member as defined in claim 1, wherein said transverse member restricted entrance further comprises an electrical cable strain relief to help prevent damage to the connection between said second electrical cable and the connector connected thereto.

12. A selectively applied lock member as defined in claim 1, wherein said transverse member has a recess adjacent said restricted entrance; said recess defining two shoulders to engage the electrical connector connected to said second electrical cable to prevent its unwanted removal from said lock member.

13. A selectively applied lock member as defined in claim 11, wherein said second electrical cable has a built-up region adjacent its electrical connector and said electrical cable strain relief grips said built-up region of said second electrical cable to help prevent damage to the connection between said second electrical cable and the connector connected thereto.

* * * * *